United States Patent [19]

Mayr

[11] 4,344,608

[45] Aug. 17, 1982

[54] TILT DRIVE COUPLING FOR STEEL MAKING CONVERTER

[75] Inventor: Erwin Mayr, Augsburg, Fed. Rep. of Germany

[73] Assignee: Zahnraderfabrik Renk A.G., Augsburg, Fed. Rep. of Germany

[21] Appl. No.: 318,318

[22] Filed: Nov. 5, 1981

[30] Foreign Application Priority Data

Nov. 21, 1980 [DE] Fed. Rep. of Germany ..... 3043850

[51] Int. Cl.[3] ..... C21C 5/50

[52] U.S. Cl. ..... 266/245; 266/246

[58] Field of Search ..... 266/245–247

[56] References Cited

U.S. PATENT DOCUMENTS

| | | | |
|---|---|---|---|
| 3,951,390 | 4/1976 | Krause | 266/246 |
| 3,977,659 | 8/1976 | Kraizinger | 266/245 |
| 4,023,785 | 5/1977 | Riegler | 266/245 |

OTHER PUBLICATIONS

Takahashi, "The Vessel Exchanging System in Basic Oxygen Furnace Shop", Association of Iron and Steel Engineers, 9/77.

*Primary Examiner*—P. D. Rosenberg
*Attorney, Agent, or Firm*—Natter & Natter

[57] ABSTRACT

A crucible of a converter is mounted to a pair of supports and releasably coupled to a tilt drive. Secured to each of the supports is a bearing assembly within which a crucible trunnion is journalled. A slidable coupling shaft interconnects an internally toothed output gear of the tilt drive and an internally toothed gear fixed to one of the trunnions. The coupling shaft includes a spur gear adjacent each of its ends. One coupling gear engages the trunnion internal gear while the other engages the tilt drive internal gear. The peripheral surface of each coupling gear comprises a spherical segment to provide an articulated connection for accommodating axial misalignment between the trunnion and the tilt drive internal gears. To disconnect the crucible from the tilt drive, the coupling shaft is displaced axially away from the trunnion until the spherical segment gear disengages the trunnion gear. The coupling shaft includes a spindle coaxially mounted to its tilt drive end. A threaded portion of the spindle is in engagement with a worm driven gear wheel hub whose rotation axially displaces the spindle to move the coupling shaft.

11 Claims, 3 Drawing Figures

TILT DRIVE COUPLING FOR STEEL MAKING CONVERTER

BACKGROUND OF THE INVENTION

1. Field of the Invention

This invention relates generally to steel making apparatus and more particularly to an improved coupling for releasably interconnecting a tilt drive with a crucible trunnion.

2. Brief Description of the Prior Art

Converters have been employed for many years in steel refining processes. In operation, a charge of molten pig iron was loaded into a refractory lined crucible and the impurities were oxidized by the forced introduction of air and/or oxygen through tuyeres, lances, etc.

Crucibles were provided with a pair of trunnions mounted to bearing assemblies for rotation along a horizontal axis to position the converter for various stages of operation, such as charging, blowing, discharging slag, and discharging the refined steel. Power tilt drives were interconnected to the converter for tilting the converter about the bearing assemblies.

Converter crucibles were lined with refractory brick which, after periods of usage, required replacement. Rather than relining crucibles at their blast stations, crucibles together with their trunnions and bearing assemblies have been removed from the blast stations as a complete unit and were transported to a maintenance station for relining. A substitute crucible was positioned at the blast station for continued steel making during the relining procedure.

In order to remove a crucible vessel from its blast station for relining, the coupling between the crucible and its tilt drive was required to be disconnected. This procedure has heretofore been accomplished with the assistance of a crane which was employed to support the coupling, as discussed by Toshimasa Takahashi, at page 24, in the 1977 *Annual Convention and Iron and Steel Exhibition of the Association of Iron and Steel Engineers at Cleveland, Ohio.* The crane was required for precise axial adjustment of the coupling whose end flanges were bolted to the crucible and/or tilt drive. The procedure required several workers and a considerable period of time.

SUMMARY OF THE INVENTION

A coupling shaft between a trunnion of a crucible vessel and a tilt drive includes a spherical segment spur gear at each end. One of the spur gears engages an internal gear fixed to the trunnion, and the other spur gear engages an internal gear of the tilt drive.

Controlled axial displacement of the coupling shaft is provided for selectively engaging or disengaging the coupling shaft from the trunnion. A spindle mounted to the tilt drive end of the coupling shaft includes a threaded portion engaged in a worm driven gear wheel hub for displacing the coupling shaft.

In order to maintain the horizontal position of the coupling after disengagement from the trunnion gear, the tilt drive includes a bracket which projects toward the crucible trunnion and carries a coupling shaft abutment support.

From the above compendium, it will be seen that it is an object of the present invention to provide a tilt drive coupling of the general character described which is not subject to the disadvantages of the prior art as aforementioned.

A further object of the present invention is to provide a drive coupling of the general character described between a crucible and a tilt drive and which may be operably connected to or disconnected from the crucible in a minimum amount of time.

A further object of the present invention is to provide a drive coupling of the general character described between a crucible and a tilt drive which may be operatively connected to or disconnected from the crucible by a single worker.

Yet another object of the present invention is to provide a drive coupling of the general character described between a crucible and a tilt drive which may be operably connected to or disconnected from the crucible without servicing equipment or tools.

A still further object of the present invention is to provide a drive coupling of the general character described between a crucible and a tilt drive which eliminates material stresses due to axial misalignment between the driving and driven components of the converter.

Yet another object of the present invention is to provide a drive coupling of the general character described between a crucible and a tilt drive which is operatively connected to the crucible without the employment of mounting flanges.

Another object of the present invention is to provide an articulate coupling of the general character described between a driving and driven component having substantially aligned axes of rotation and which accommodates for misalignment between the driving and driven axes of rotation through spherical segment gearing.

Another object of the present invention is to provide a drive coupling of the general character described between a crucible and a tilt drive which reduces the costs of installation and removal of crucibles.

Other objects of the invention in part will be obvious and in part will be pointed out hereinafter.

With these ends in view, the invention finds embodiment in certain combinations of elements, arrangements of parts and series of steps by which the said objects and certain other objects are attained, all with reference to the accompanying drawings and the scope of which is more particularly pointed out and indicated in the appended claims.

BRIEF DESCRIPTION OF THE DRAWINGS

In the accompanying drawings in which is shown one of the various possible exemplary embodiments of the invention.

DESCRIPTION OF THE PREFERRED EMBODIMENT

Figure 1:
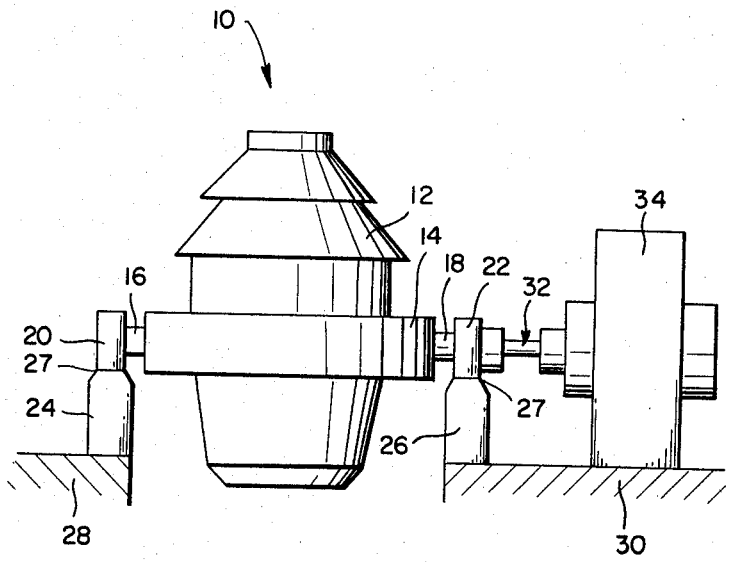
FIG. 1 is a schematized diagrammatic representation of a steel making converter including a crucible vessel, a tilt drive and a coupling constructed in accordance with and embodying the invention interconnecting the crucible and the tilt drive.

Referring now in detail to the drawings, the reference numeral 10 denotes generally a converter blast station at a steel refining plant. As shown in FIG. 1, the converter blast station 10 includes a crucible vessel 12 carried by a circumscribing mounting ring 14. A pair of trunnions 16, 18 projects radially from diametrically opposed portions of the ring 14. The trunnions 16, 18 are received within journal bearing assemblies 20, 22, respectively. Each of the journal bearing assemblies 20, 22 is releasably secured to a support column 24, 26 respectively, along an upper surface 27 of each column. The columns 24, 26 are anchored to an appropriate foundation 28, 30.

Figure 2:
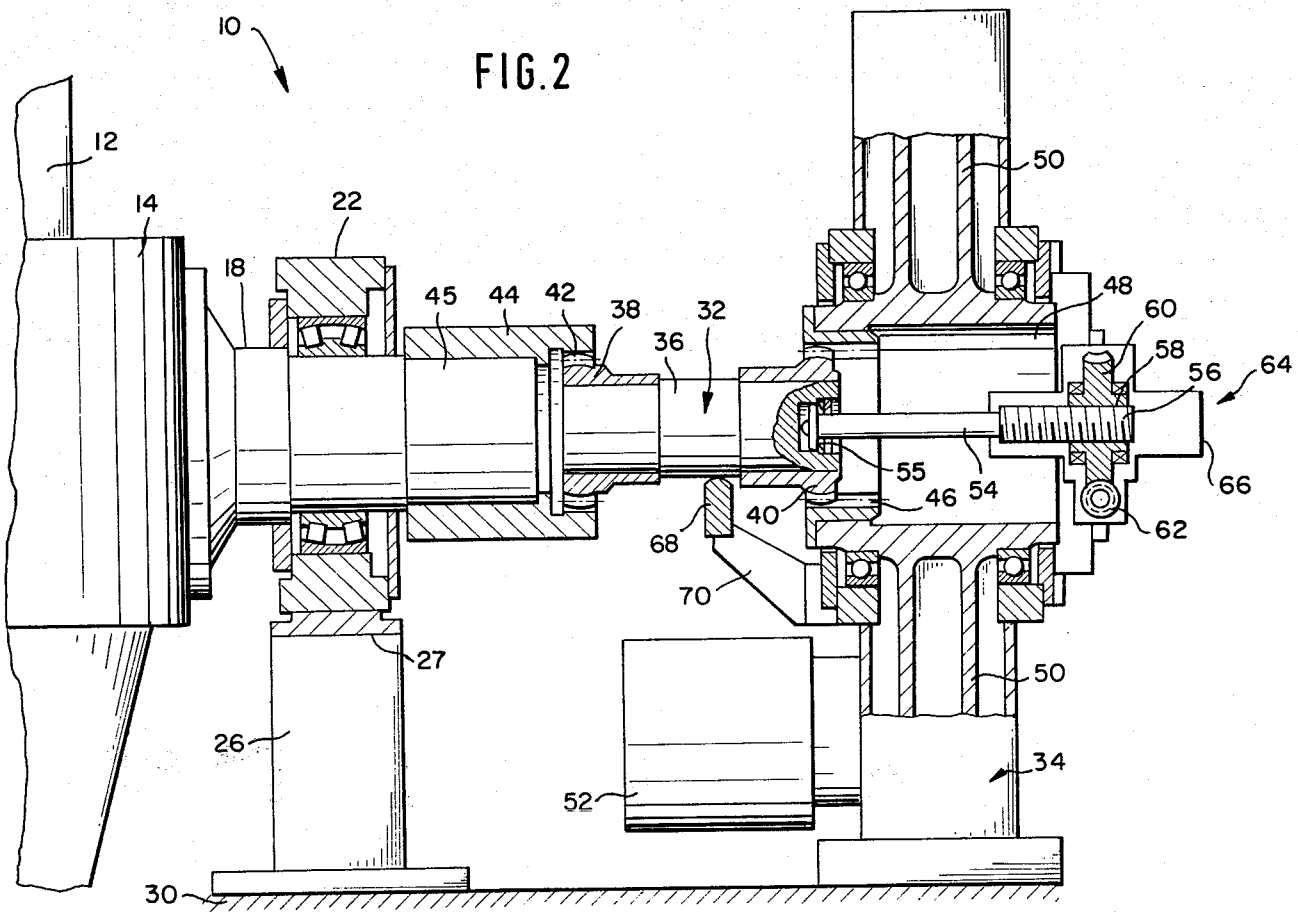
FIG. 2 is an enlarged scale fragmentary sectional view through the tilt drive and a crucible journal bearing assembly, the same being taken along a common vertical plane, and showing the coupling drivingly engaging a trunnion of the crucible.

In accordance with the present invention, an articulately jointed tilt drive coupling 32 releasably interconnects the trunnion 18 with an output gear of a tilt drive 34. As illustrated in FIG. 2, the coupling 32 includes a torque transmitting shaft 36. Fixed to the opposite ends of the shaft 36 are spur gears 38, 40. Each of the spur gears 38, 40 comprises a spherical segment along its peripheral tooth surface. The spur gear 38 engages the teeth of an internal gear 42 formed in a collar 44 which is fixed to an extension 45 of the trunnion 18 which projects beyond the journal bearing assembly 22.

At the opposite end of the shaft 36, the spur gear 40 includes teeth which are received within an internal gear 46 of the tilt drive 34. The internal gear 46 is fixed within an axial aperture 48 formed in the hub of a gear wheel 50 of the tilt drive 34. A motor 52 and a suitable gear train drive the gear wheel 50. The axes of the gear wheel 50 and the internal gear 46 are preferably registered with the axes of the journal bearing assemblies 20, 22.

To permit selective disengagement between the coupling 32 and the trunnion internal gear 42, a spindle 54 extends from the shaft 36 into the aperture 48. The spindle is mounted at one end 55 to the shaft 36 adjacent the spur gear 40. A threaded section 56 of the spindle 54 extends through a matingly threaded hub 58 of a coaxial gear wheel 60. The gear wheel 60 is, in turn, driven by a worm 62. The spindle 54, gear wheel 60 and worm 62 form a control mechanism 64 for selectively positioning the spur gear 38 of the tilt drive coupling 32 within the internal gear 42 or for removing the spur gear 38 from the internal gear 42.

The worm and gear wheel of the control mechanism 64 are carried within a housing 66 which fixes the gear wheel 60 relative to the coupling 32. The housing 66 is carried on and fixed to the tilt drive housing.

When the crucible vessel 12 is to be relined with refractory brick, it is removed from the blast station as a unit together with the mounting ring 14, the trunnions 16, 18 and the journal bearing assemblies 20, 22. The journal bearing assemblies 20, 22 are mounted to the upper surface 27 of their support columns 24, 26 by bolts or the like, which, of course, must be released.

Figure 3:
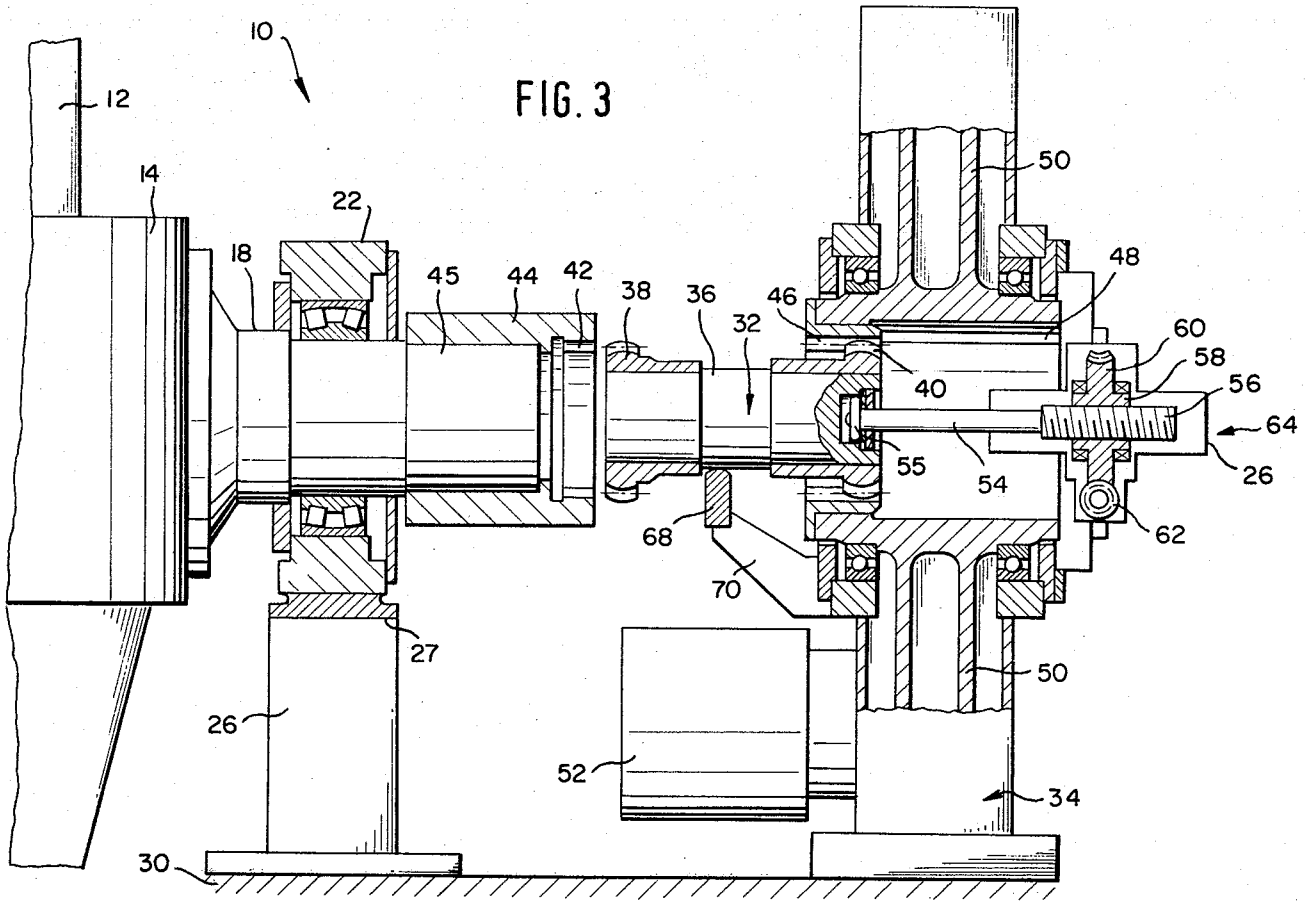
FIG. 3 is an enlarged fragmentary sectional view similar to that of FIG. 2 but showing the coupling disengaged from the trunnion.

In order to disengage the coupling 32 from the trunnion 18, the worm 62 is rotated, either manually through a crank or wheel or by a motor. Such worm rotation drives the gear wheel 60 which causes the spindle 54 to translate toward the right as viewed in FIG. 2 to a position as shown in FIG. 3. This movement of the spindle 54 draws the spur gear 40 deeper into the internal gear 46. When the spindle 54 is in the position shown in FIG. 3, the spur gear 38 has been disengaged from the internal gear 42 of the trunnion collar 44. Because the axial tooth width of the internal gear 46 is greater than that of the internal gear 42, the spur gear 40 remains engaged in the internal gear 46.

It should be noted that when the spur gear 38 is disengaged, the coupling shaft 36 is maintained in generally horizontal alignment with the axis of the journal bearing assembly 22 by engagement against a support 68 which is carried on a bracket 70 projecting from the tilt drive housing. In absence of the support 68, the coupling shaft 36 would pivot in a counterclockwise direction as viewed in FIG. 3 because the sperical segment surface of the spur gear 40 provides an articulate engagement with the internal gear 46.

After the coupling 32 is disengaged, the crucible vessel 12 can be lifted and transported to a maintenance station and a substitute crucible, together with its journal bearing assemblies mounted to the support columns 24, 26.

The spur gear 38 of the coupling 32 is then engaged with an internal gear fixed to the trunnion of the substitute crucible by reversing the direction of rotation of the worm 62. In the event the teeth of the internal gear 42 are not in registry with the teeth of the spur gear 38, the gear wheel 50 is rotated through the motor 52 which rotates the internal gear 46 and the shaft 36 until tooth alignment has been achieved.

It should be appreciated that the spherical segment gears 38, 40 at the ends of the drive coupling shaft 36 provide flexible articulate driving connections between the internal gear 46 of the gear wheel 50 and the internal gear 42 of the trunnion 18. Hence, potentially harmful material stresses which would occur in the event a rigid coupling were utilized are obviated.

Thus it will be seen that there is provided a tilt drive coupling which achieves the various objects of the invention and which is well suited to meet the conditions of practical usage.

As various changes might be made in the tilt drive coupling as above set forth, it is to be understood that all matter herein described or shown in the accompanying drawings is to be interpreted as illustrative and not in a limiting sense.

Having thus described the invention, there is claimed as new and desired to be secured by Letters Patent:

1. A drive coupling for selectively interconnecting a crucible vessel and a tilt drive of a converter, the crucible vessel having a pair of trunnions and means journalling the trunnions about a horizontal axis for tilting the crucible to various operative positions, the tilt drive including means for providing a rotative output, the crucible including means for engaging the drive coupling, the coupling including a shaft, the shaft having means for driving the coupling engaging means, the shaft having means for engaging the rotative output means whereby the tilt drive is operable to rotate the crucible about the trunnion journalling means to selected positions, the coupling further including means for selectively disengaging and engaging the coupling engaging means of the crucible, the selective disengaging and engaging means including means for axially moving the shaft away from and toward the crucible coupling engaging means whereby the coupling is disengaged by moving the shaft away from the crucible to permit removal of the crucible and engaged with a crucible to be installed by moving the shaft toward the crucible.

2. A drive coupling constructed in accordance with claim 1 for selectively interconnecting a crucible vessel and a tilt drive of a converter wherein the means for axially moving the shaft comprises a threaded spindle, means connecting the threaded spindle to the shaft adjacent the tilt drive, a worm wheel having an internally threaded hub, the threaded spindle being engaged in the hub, and a worm in engagement with the worm wheel for selectively rotating the worm wheel in opposite directions of rotation whereby the shaft is axially moved toward or away from the crucible.

3. A drive coupling constructed in accordance with claim 1 for selectively interconnecting a crucible vessel and a tilt drive of a converter wherein the means for engaging the drive coupling comprises gear means engaging one of the trunnions and the means for driving the coupling engaging means comprises a spur gear.

4. A tilt drive coupling constructed in accordance with claim 3 wherein the gear means comprises an internal gear and the peripheral surface of the spur gear comprises a spherical segment whereby a flexible drive coupling is provided.

5. A tilt drive coupling constructed in accordance with claim 4 wherein the rotative output means comprises an internal gear and the means for engaging the rotative output means includes a spur gear having a peripheral surface comprising a spherical segment whereby an articulate flexible drive coupling is provided to reduce stress.

6. A drive coupling constructed in accordance with claim 1 for selectively interconnecting a crucible vessel and a tilt drive of a converter wherein the axis of the rotative output means is substantially coincident with the axis of rotation of the coupling engaging means, the drive coupling further including support means for maintaining the shaft substantially within the coincident axes when the coupling engaging means is not engaging the coupling, whereby when the coupling is disengaged, registration of a coupling engaging means and the shaft is facilitated.

7. A drive coupling constructed in accordance with claim 6 wherein the shaft is supported by both the support means and the rotative output means when the coupling is disengaged.

8. A drive coupling constructed in accordance with claim 3 wherein the gear means is coaxial with the one trunnion, the rotative output means being substantially coaxial with the horizontal axis.

9. A tilt drive coupling constructed in accordance with claim 1 wherein the tilt drive includes a gear wheel, the gear wheel including an axial aperture, the selective disengaging means for axially moving the shaft away from the crucible including means for moving the shaft into the axial aperture.

10. A drive coupling constructed in accordance with claim 3 wherein the gear means comprises an internal gear, the rotative output means comprises an internal gear and the means for engaging the rotative output means comprises a further spur gear, the axial tooth width of the tilt drive internal gear being greater than the axial tooth width of the crucible internal gear whereby the further spur gear will be maintained in engagement with the tilt drive internal gear when the coupling is disengaged.

11. A drive coupling for flexibly coupling a rotative output drive with a rotative input means for utilizing the output drive, the output drive including an internal gear, the input means including an internal gear, the coupling including a shaft and a spur gear means adjacent each end of the shaft, one spur gear means being in continuous simultaneous tooth engagement with one of the internal gears and the other spur gear being in continuous simultaneous tooth engagement with the other internal gear, each of the spur gears including a peripheral tooth surface, at least a portion of which is substantially spherical in contour, whereby a flexible articulate drive connection is provided.

* * * * *